US007802520B2

(12) United States Patent
Van Stratum

(10) Patent No.: US 7,802,520 B2
(45) Date of Patent: Sep. 28, 2010

(54) DRAG MINIMIZING PROJECTILE DELIVERY SYSTEM

(75) Inventor: Bruce G. Van Stratum, Tallahassee, FL (US)

(73) Assignee: Martin Electronics, Perry, FL (US)

( * ) Notice: Subject to any disclaimer, the term of this patent is extended or adjusted under 35 U.S.C. 154(b) by 596 days.

(21) Appl. No.: 11/881,068

(22) Filed: Jul. 25, 2007

(65) Prior Publication Data

US 2010/0212529 A1 Aug. 26, 2010

(51) Int. Cl.
*F42B 12/20* (2006.01)

(52) U.S. Cl. ..... 102/490; 102/477; 102/470; 102/440; 102/443; 102/444

(58) Field of Classification Search ..... 102/490, 102/477, 470, 440, 443, 444
See application file for complete search history.

(56) References Cited

U.S. PATENT DOCUMENTS 4,370,930 A * 2/1983 Strasser et al. ..... 102/530
4,446,794 A * 5/1984 Simmons ..... 102/513
4,754,704 A * 7/1988 Lubbers ..... 102/275.11
4,807,532 A * 2/1989 Andersson et al. ..... 102/490
4,807,535 A * 2/1989 Schilling et al. ..... 102/490
4,846,071 A * 7/1989 Franzen et al. ..... 102/490
5,353,711 A * 10/1994 Botticelli et al. ..... 102/490
5,557,059 A * 9/1996 Warren et al. ..... 102/434
5,886,289 A * 3/1999 Nixon et al. ..... 102/490
6,158,349 A * 12/2000 Altenau et al. ..... 102/490
6,213,023 B1 * 4/2001 Gunners ..... 102/490
7,004,074 B2 * 2/2006 Van Stratum ..... 102/470
7,360,355 B1 * 4/2008 Gadiot ..... 60/255
7,578,238 B1 * 8/2009 Dabiri ..... 102/490
7,644,663 B2 * 1/2010 Illesi ..... 102/498

* cited by examiner

*Primary Examiner*—Troy Chambers
*Assistant Examiner*—Samir Abdosh
(74) *Attorney, Agent, or Firm*—J. Wiley Horton

(57) ABSTRACT

A modified cartridge assembly including a projectile having a gas generator proximate its aft end. The projectile includes an aft closure having a cavity filled with gas generating material. The gas generating material is ignited around the time the projectile exits the weapon's muzzle. The gas generating material then burns while the projectile is in flight, spewing pressurized gas into the wake region immediately behind the projectile. The pressurized gas reduces the projectile's base drag.

15 Claims, 12 Drawing Sheets

DRAG MINIMIZING PROJECTILE DELIVERY SYSTEM

CROSS-REFERENCES TO RELATED APPLICATIONS

Not Applicable

STATEMENT REGARDING FEDERALLY SPONSORED RESEARCH OR DEVELOPMENT

Not Applicable.

MICROFICHE APPENDIX

Not Applicable

BACKGROUND OF THE INVENTION

1. Field of the Invention

This invention relates to the field of projectile delivery systems. More specifically, the invention comprises an improved projectile assembly having a gas generator in its aft end. The gas generator injects gas into the projectile's wake, thereby reducing the projectile's base drag.

2. Description of the Related Art

Although the present invention can be applied to many different types of projectiles, it was primarily developed as part of a propulsion system for launching 40 mm grenades (such as the U.S. Army's M433). The invention incorporates many features described in greater detail in prior U.S. Pat. No. 7,004,074 to Van Stratum (2006), which is hereby expressly incorporated by reference.

Metallic cartridges have been used to encapsulate solid propellants for many years. In recent years other materials have been substituted for the traditional brass, but the principles of operation remain the same: A projectile is seated in the open mouth of a cartridge case containing solid propellant. Ignition of the propellant is provided by percussive or electrical means. The burning propellant generates pressurized gas which forces the projectile out of the mouth of the case and then typically down a rifled bore.

The launching of a 40 mm grenade involves the same principles. The main difference, however, is the size and mass of the projectile. A typical shoulder-fired military weapon launches a projectile weighing less than 30 grams at a relatively high velocity (700-1,000 meters per second). In contrast, a 40 mm grenade weapon launches a projectile weighing over 200 grams at a relatively low velocity (70-80 meters per second). Thus, while the operating principles between the two types of weapons are the same, they can be said to operate in different regimes.

Since the human operator can only withstand a fixed amount of recoil, one cannot merely scale up the cartridge of a shoulder-fired rifle and create a useable weapon for launching 40 mm grenades. The design considerations are different. The incorporated U.S. Pat. No. 7,004,074 illustrates and describes an effective approach to the problem of launching large masses at low velocities. The '074 invention uses a high-pressure cartridge embedded within a low-pressure larger cartridge. A burst cup metering system is used to meter propellant gases from the high pressure cartridge into the low pressure cartridge, thereby accelerating the projectile in a smooth and controlled fashion. This approach helps to reduce the peak recoil loads experienced by a user. The high pressure found within the high pressure cartridge also ensures the reliable ignition and combustion of the propellant it contains.

Once the projectile is free of the rifled bore, it flies along a ballistic path until it strikes its target. The velocity of the projectile diminishes continuously due to aerodynamic drag. One of the significant components of the aerodynamic drag is the "base drag," which refers to the drag induced by the turbulent wake region immediately behind the projectile. The present invention seeks to reduce the base drag, thereby extending the projectile's range using a given amount of powder. As an alternative, the invention also allows a smaller amount of powder to be used while achieving the same range as a prior art projectile. The smaller amount of powder means reduced recoil for the person firing the weapon.

BRIEF SUMMARY OF THE INVENTION

The present invention is a modified cartridge assembly including a projectile having a gas generator proximate its aft end. FIG. 1 shows cartridge assembly 10. Projectile assembly 14 is launched by propellant assembly 18. FIG. 4 shows projectile assembly 14 sectioned in half to show internal details. Aft closure 50 includes cavity 58, which is filled with gas generating material 66. Other ignition components are included as well. The gas generating material is ignited at or before the time the projectile exits the weapon's muzzle. The gas generating material then burns while the projectile is in flight, spewing pressurized gas into the wake region immediately behind the projectile. The pressurized gas reduces the projectile's base drag.

The gas generating assembly can be used with a variety of projectile payloads. Examples include smoke rounds, marker flares, and high explosive rounds. Some of the specific details are preferably altered to suit each different type of projectile payload, but the operating principles remain the same. The reduction in base drag increases the projectile's range for a given amount of propellant. Alternatively, a reduced amount of propellant can be used while maintaining the same range as a prior art projectile. The reduction in propellant reduces recoil forces when the weapon is fired.

REFERENCE NUMERALS IN THE DRAWINGS

| | | | |
|---|---|---|---|
| 10 | cartridge assembly | 12 | low pressure case |
| 14 | projectile assembly | 16 | rifling ring |
| 18 | propellant assembly | 20 | nose cap |
| 22 | extraction flange | 24 | base |
| 26 | high pressure cartridge receiver | 30 | low pressure chamber |
| 28 | charge casing | 31 | high pressure chamber |
| 32 | payload | 36 | propellant |
| 34 | percussion primer | 40 | projectile base |
| 38 | sleeve | 46 | burst cup |
| 42 | high pressure cartridge | 50 | aft closure |
| 48 | smoke material | 54 | ignition material |
| 52 | charge vent hole | 58 | cavity |
| 56 | expansion nozzle | 62 | black powder layer |
| 60 | bulkhead | 66 | gas generating material |
| 64 | ignition material | 70 | output opening |
| 68 | igniter charge | 74 | recess |
| 72 | side wall | 78 | rifled bore |
| 76 | aft opening | 82 | air flow |
| 80 | propellant gas | 86 | ground |
| 84 | effective expansion | 90 | secondary vent |
| 88 | smoke | 94 | black powder layer |
| 92 | illuminant igniter | | |
| 96 | illuminant composition | | |

DETAILED DESCRIPTION OF THE INVENTION

Figure 1:
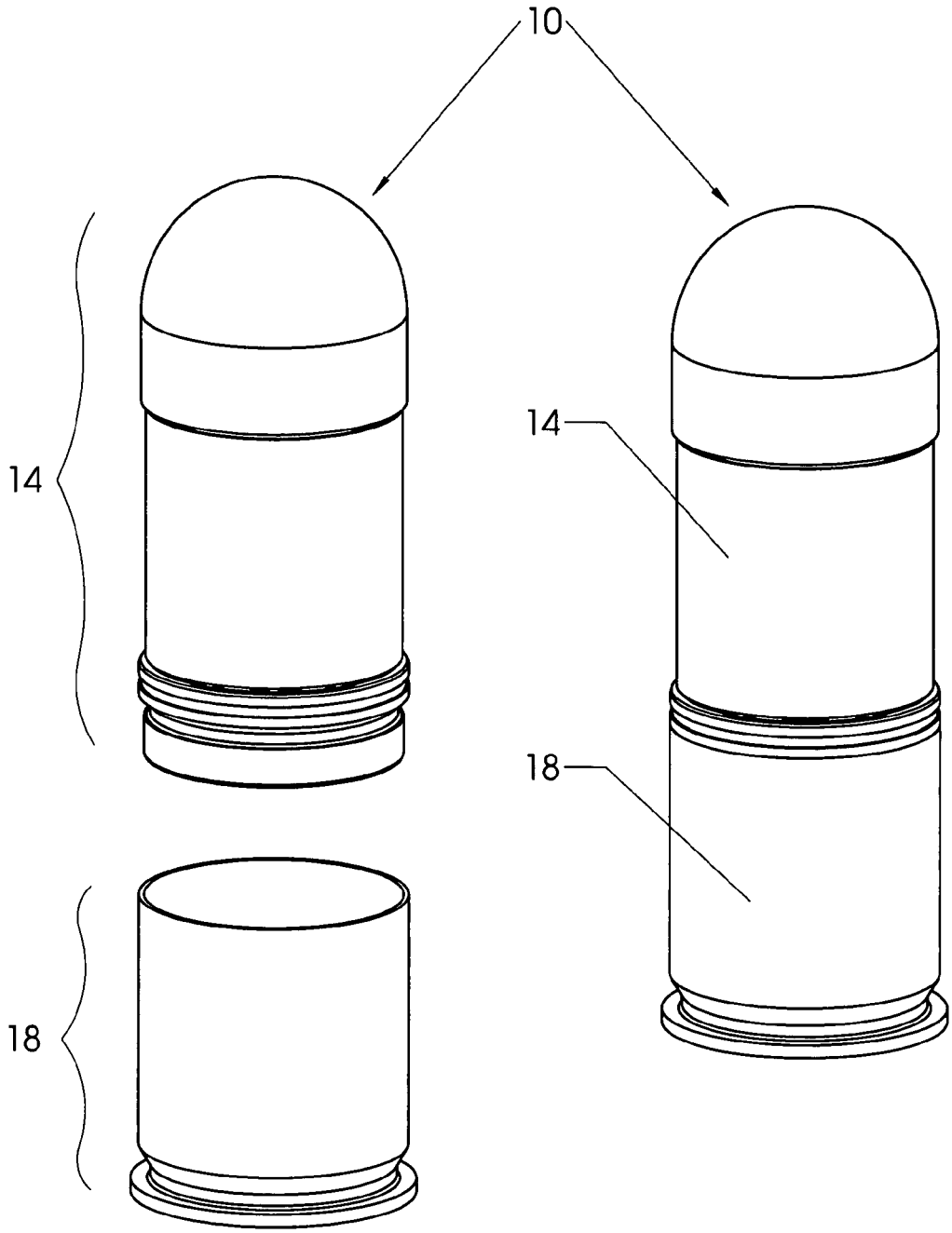
FIG. 1 is a perspective view, showing a projectile assembly in both an exploded and an assembled state.

FIG. 1 shows the major components of a 40 mm cartridge assembly 10. Propellant assembly 18 has an open mouth at one end, into which projectile assembly 14 is inserted. The left hand view in FIG. 1 shows the propellant and projectile assemblies separated while the right hand view shows the two united.

Figure 2:
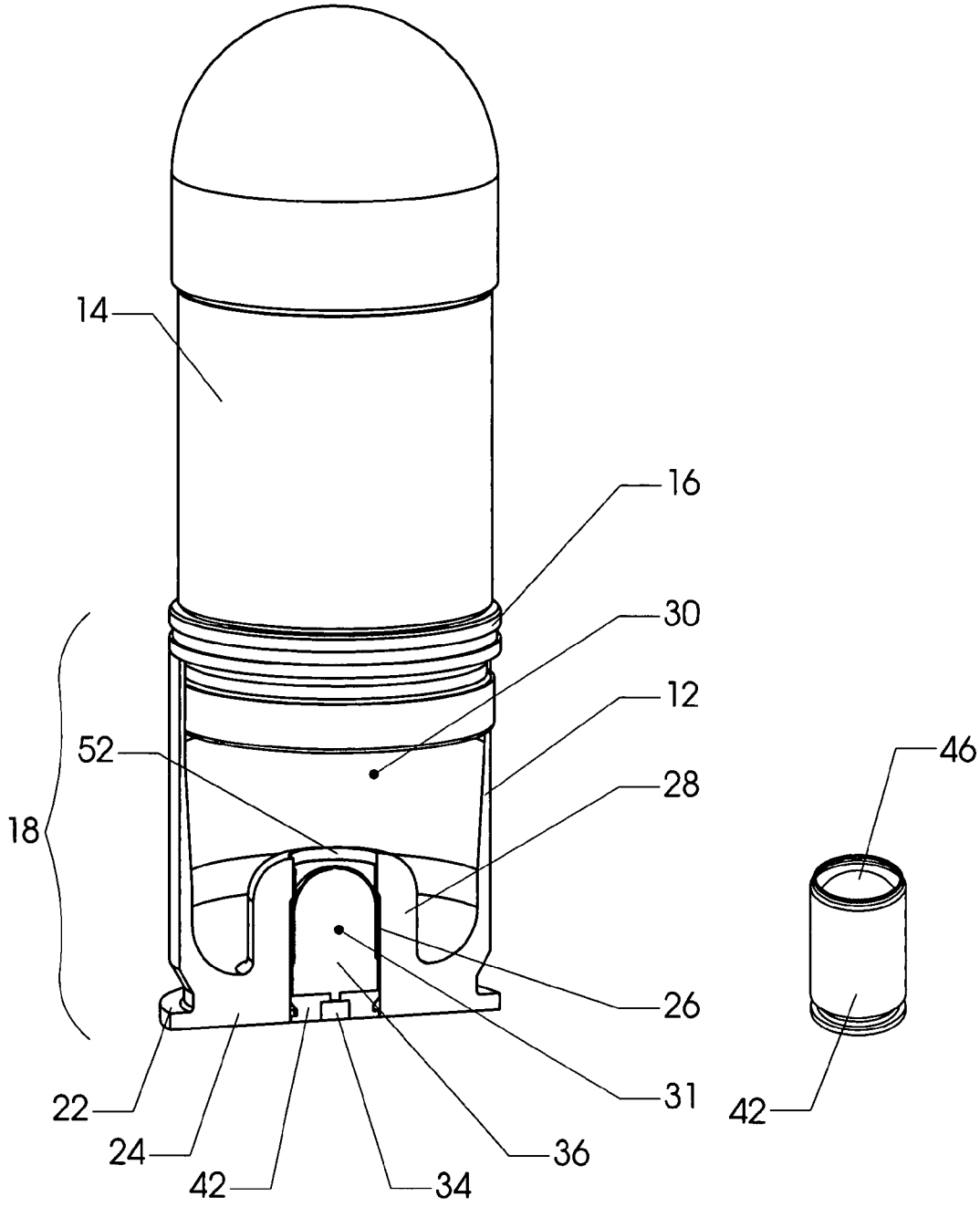
FIG. 2 is a perspective view with a partial cutaway, showing internal details of the High-Low propellant assembly.

FIG. 2 shows the united cartridge assembly with the front half of propellant assembly 18 cut away to reveal internal details. The reader will observe that the aft portion (the lower portion in the orientation shown in the view) of the projectile assembly includes rifling ring 16. The rifling ring typically engages a rifled bore within a weapon designed to launch the projectile assembly. This engagement causes the projectile assembly to spin as it travels down the bore, thereby stabilizing it in flight.

Propellant assembly 18 is a high/low pressure launch system, as described more particularly in the incorporated U.S. Pat. No. 7,004,074 to Van Stratum (2006). High pressure cartridge 42 contains propellant 36 (housed within high pressure chamber 31). High pressure chamber 31 is separated from low pressure chamber 30 by a rupturable burst cup 46 (The burst cup is labeled in a non-sectioned view of the high pressure cartridge shown in the right hand portion of FIG. 2).

Low pressure case 12 includes base 24, which opens into high pressure cartridge receiver 26. The base also includes a conventional extraction flange 22, which is used to remove the spent casing from the firing chamber. Charge casing 28 preferably surrounds and reinforces the high pressure cartridge. It includes charge vent hole 52, which lies directly over the high pressure cartridge. The round is ignited by striking percussion primer 34. This action ignites the propellant and ruptures burst cup 46. Hot propellant gases are then metered from high pressure chamber 31 to low pressure chamber 30. The gases force the projectile assembly away from the propellant assembly and accelerate it down the rifled bore of the firing weapon.

The use of the high pressure cartridge with charge vent hole 52 is particularly advantageous for the present invention. When the burst cup ruptures, a stream of hot propellant gas is directed up through the charge vent hole and against the aft portion of the projectile. This directed stream of hot propellant gas serves to ignite components placed in the aft end of the projectile, as will be described subsequently.

Figure 3:
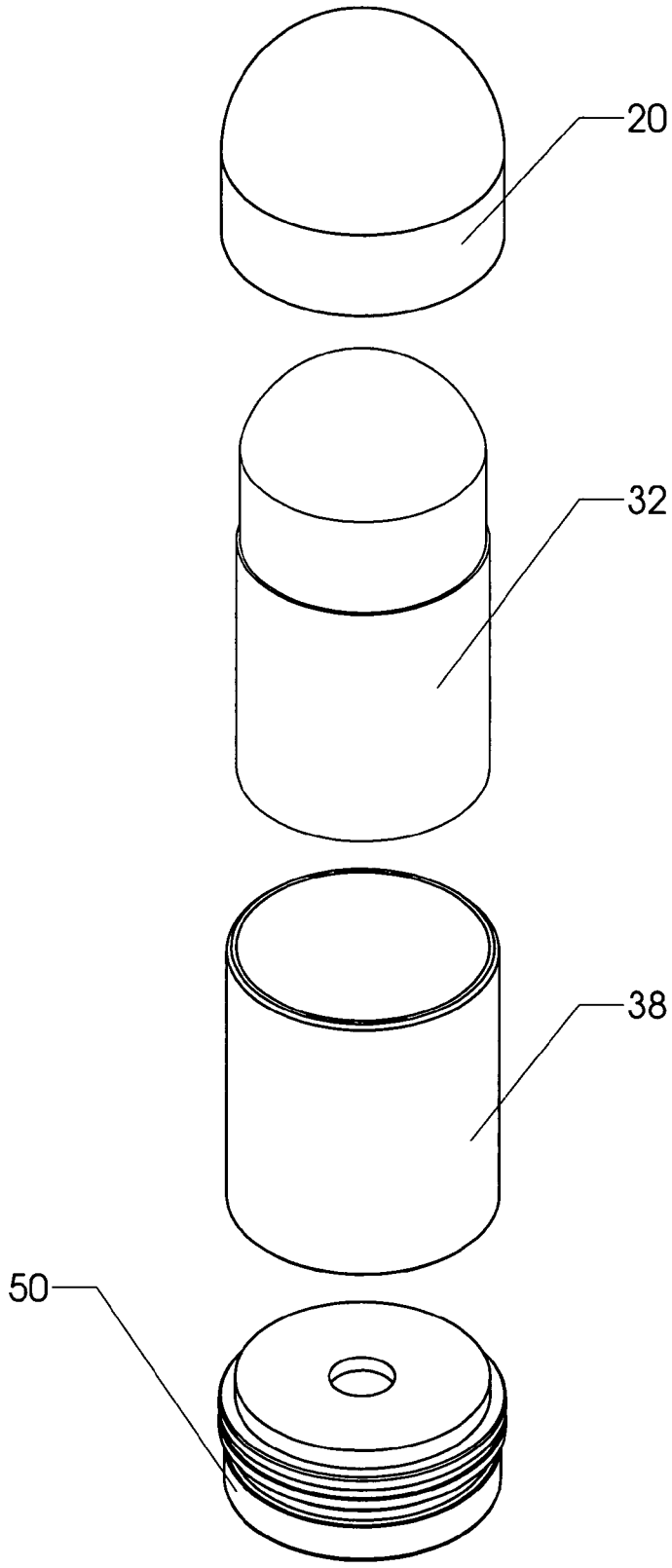
FIG. 3 is an exploded perspective view, showing the components of a projectile assembly.

FIG. 3 shows typical components comprising the projectile assembly. Aft closure 50 forms the aft portion of the assembly. It includes the rifling ring and is the portion which actually seats into the open mouth of the propellant case. Sleeve 38 typically attaches to the aft closure, such as by a threaded engagement. Nose cap 20 attaches to sleeve 38. A hollow interior is thereby formed, into which a suitable payload 32 can be placed. Payload 32 can assume many forms, including high explosives, marker flares, illuminating flares, and smoke markers.

Figure 4:
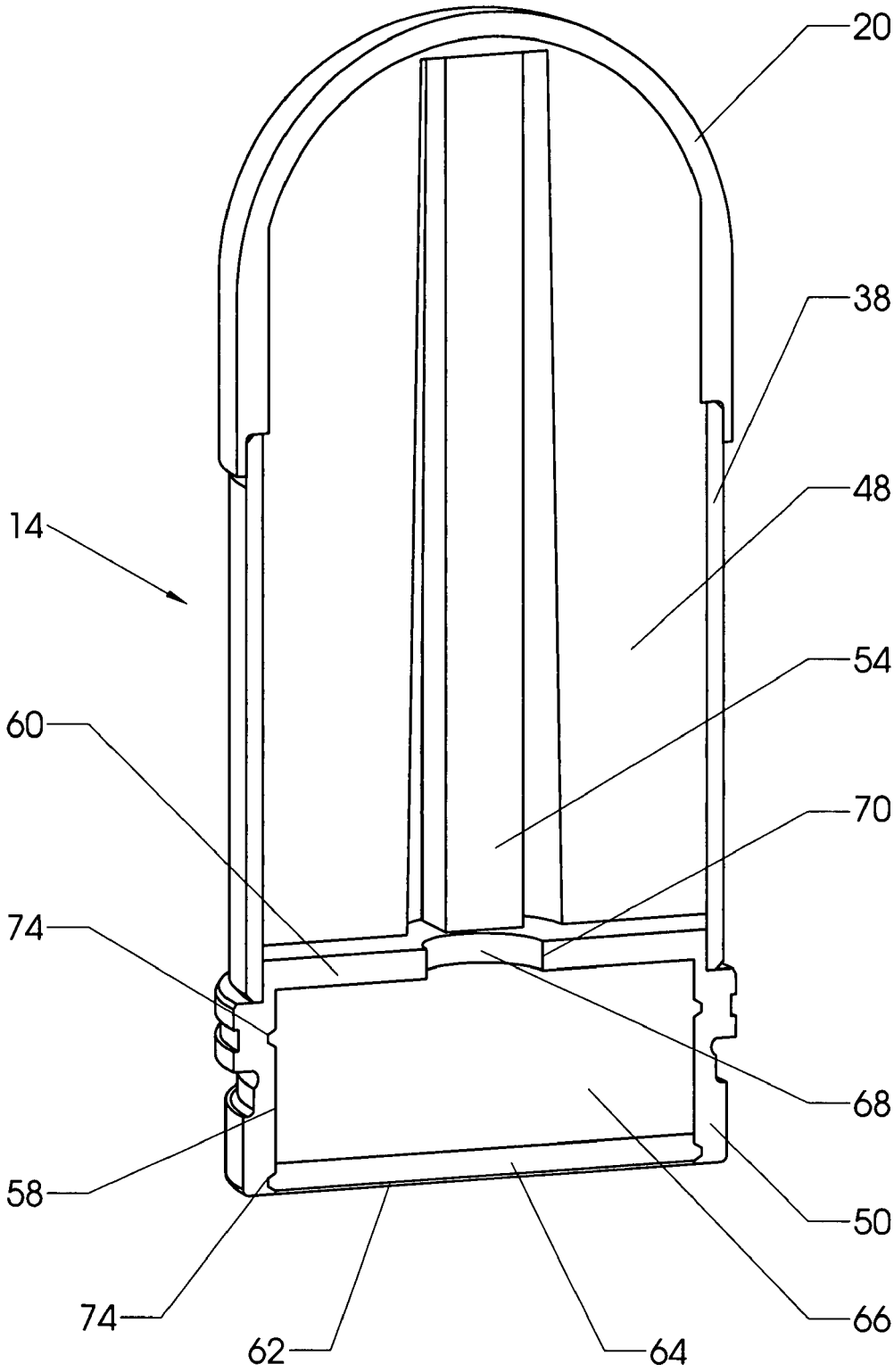
FIG. 4 is a sectional perspective view, showing internal details of a projectile assembly.

FIG. 4 shows a completed projectile assembly which has been sectioned in half. The particular example illustrated is a smoke round. The reader will observe that the aft portion of aft closure 50 includes cavity 58. The forward portion of the aft closure is sealed by bulkhead 60. Output opening 70 passes through bulkhead 60 in order to allow communication between cavity 58 and the payload located in front of the bulkhead.

Cavity 58 is filled with several layers of material. Black powder layer 62 covers the aft extreme. Just forward of the black powder layer is a layer of ignition material 64. The rest of cavity 58 is filled with gas generating material 66. Igniter charge 68 fills output opening 70. Those skilled in the art will know that some of these materials are granular. A good example would be the black powder layer, which is composed of very fine grains of black powder. Binding agents are used to adhere the granules together and possibly to adhere the layers together. One or more mechanical interference features such as annular recesses 74 are also preferably provided in cavity 58's side wall. These annular recesses create a mechanical interference with the materials contained within the cavity, thereby holding them in position. Other mechanical interference features could be used, such as steps in the cavity's diameter or threads. The contents of the cavity are typically pressed into place so that voids are eliminated.

The example of FIG. 4 being a smoke round, the payload includes smoke material 48. The smoke material is a solid substance which when ignited produces copious volumes of smoke. A hollow central core is formed in this material. The hollow central core is filled by ignition material 54 (preferably a pressed ignition composition which fills the hollow central core). While the details of the ignition material and smoke material are beyond the scope of this disclosure, the reader may generally wish to know that the foam readily ignites and burns very rapidly, thereby providing a good ignition source for the smoke material itself.

When projectile assembly 14 is launched via the ignition of propellant assembly 18, a sequence of ignition events transpires. First, the hot gases produced by the propellant assembly impinge upon black powder layer 62, which readily ignites. Black powder layer 62 ignites ignition material 64, which provides a uniformly combusting layer. Ignition material 64 then ignites gas generating material 66. Gas generating material 66 produces a steady volume of gas, which is ejected from the rear of the projectile (primarily during the projectile's flight).

When the gas generating material is nearly consumed, it ignites ignition charge 68. Ignition charge 68 ignites ignition material 54, which in turn ignites smoke material 48. The smoke produced by the smoke material is then vented back through output opening 70. This sequence will be described with respect to the projectile's flight momentarily.

Figure 5:
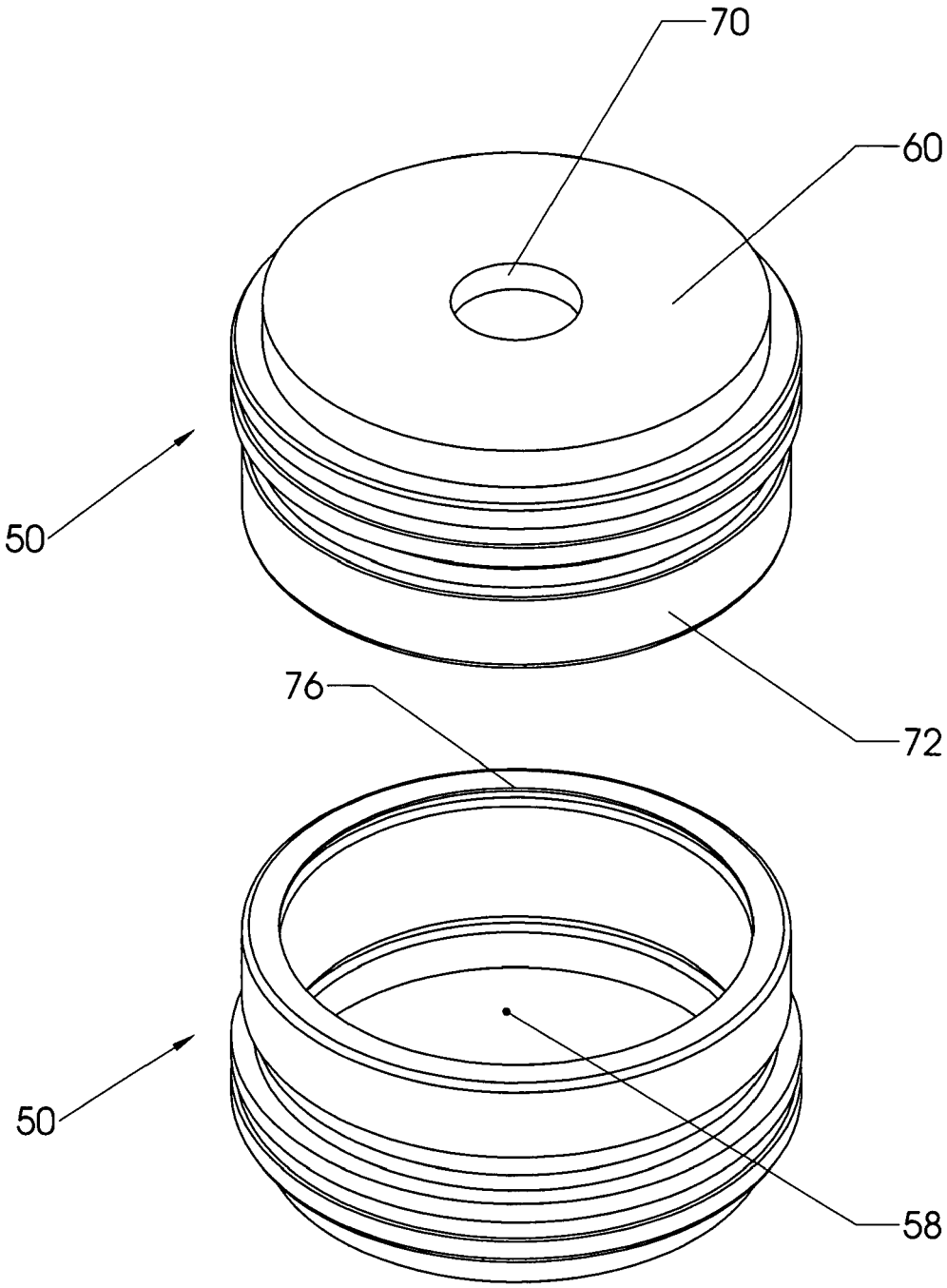
FIG. 5 is a perspective view, showing the aft closure, which contains the gas generating material.

FIG. 5 shows two views of aft closure 50 without any of the internal materials in place. The upper view shows the aft closure in the same orientation as FIG. 4, while the lower view shows it inverted. In the upper view the reader will observe how bulkhead 60 opens into output opening 70, which leads into cavity 58. In the lower view, the reader will observe that cavity 58 vents to the surrounding atmosphere via aft opening 76.

Figure 6:
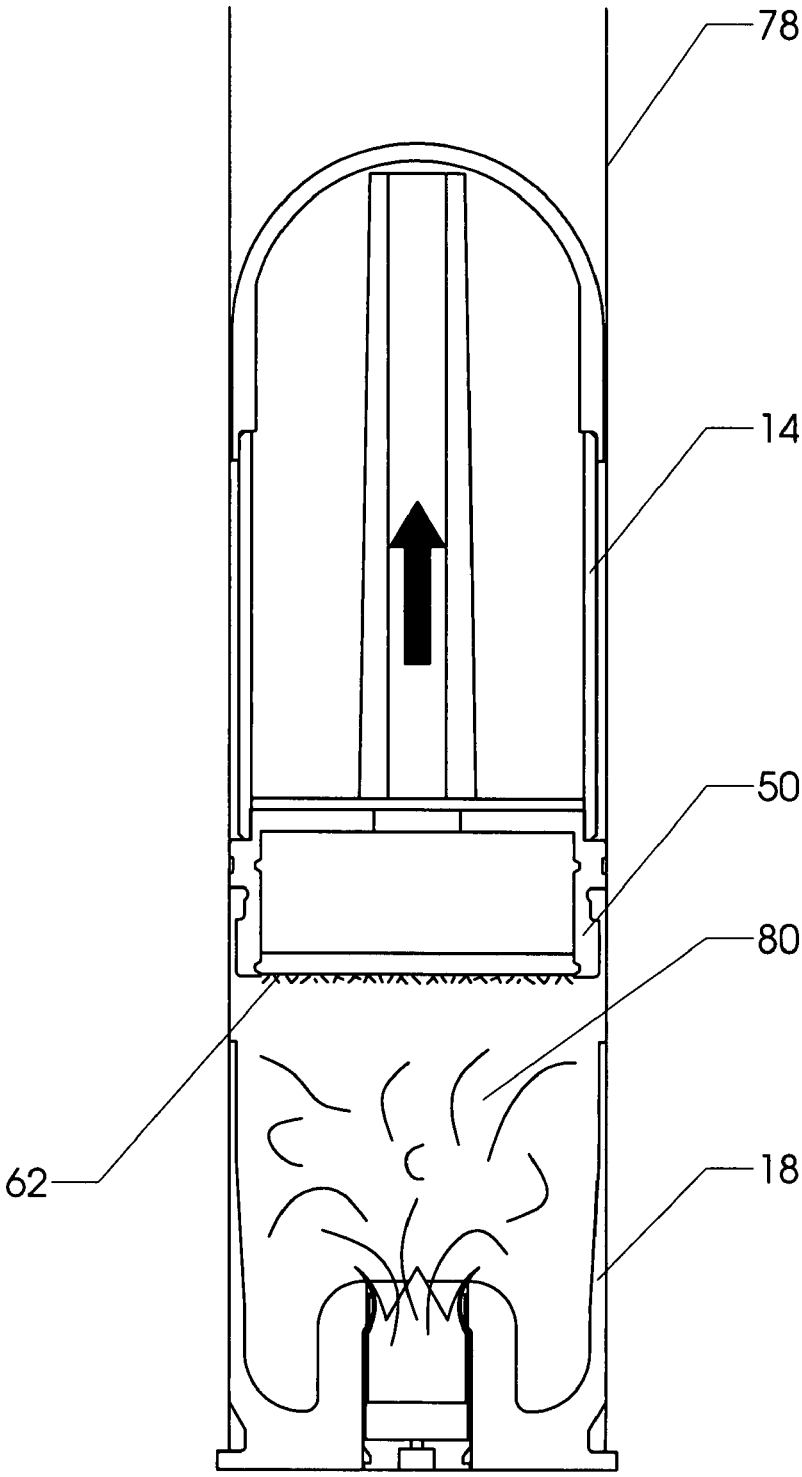
FIG. 6 is a sectional view, showing the detonation of a cartridge assembly.

FIGS. 6 through 10 show the firing sequence for the smoke round of FIG. 4. In FIG. 6, the propellant assembly has ignited. Propellant gas 80 has started to accelerate projectile assembly 14 down rifled bore 78. The impingement of the stream of hot propellant gases shooting through charge vent hole 52 against the aft portion of the projectile has also ignited black powder layer 62.

Figure 7:
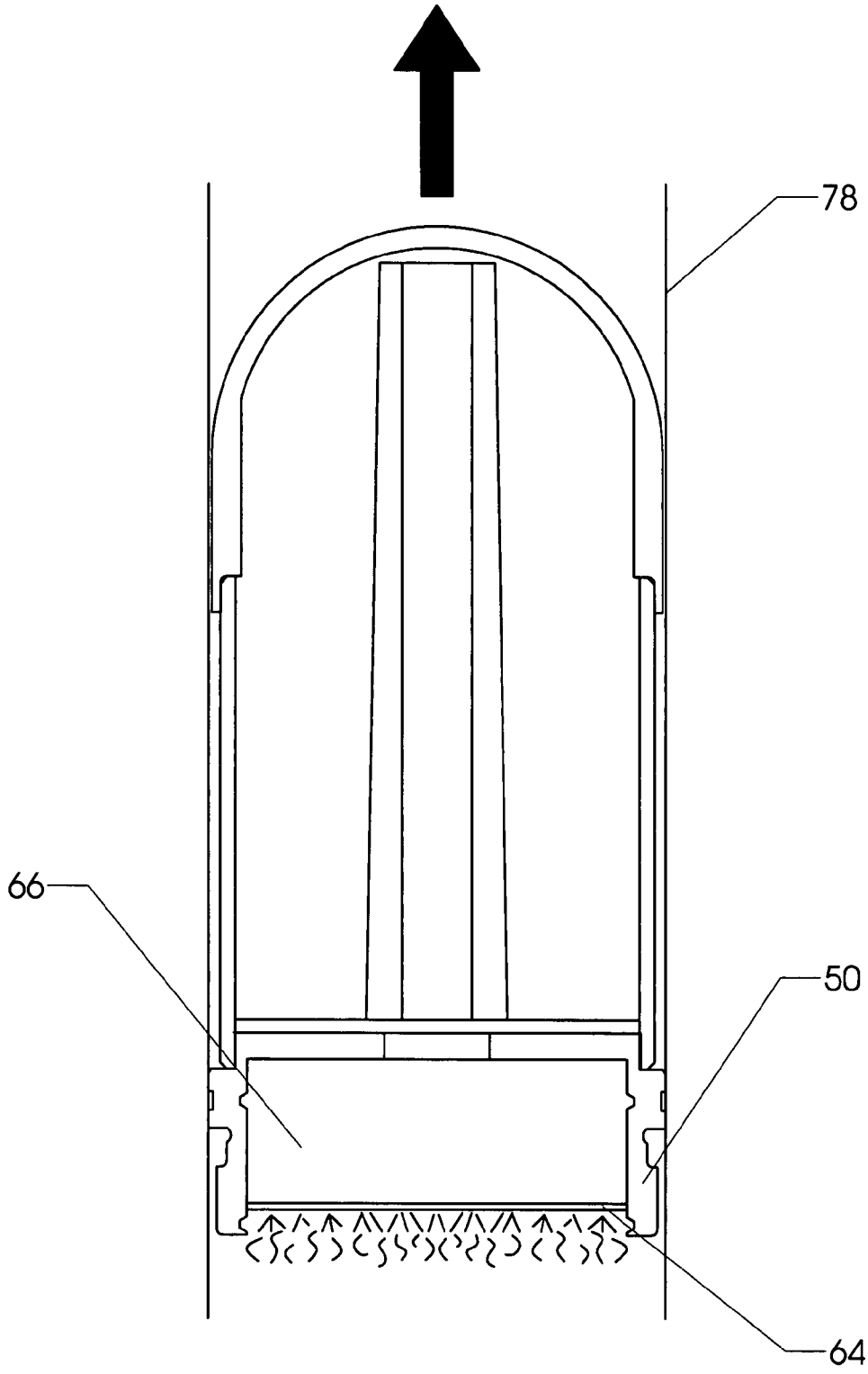
FIG. 7 is a sectional view, showing the ignition of the gas generating material.
Figure 8:
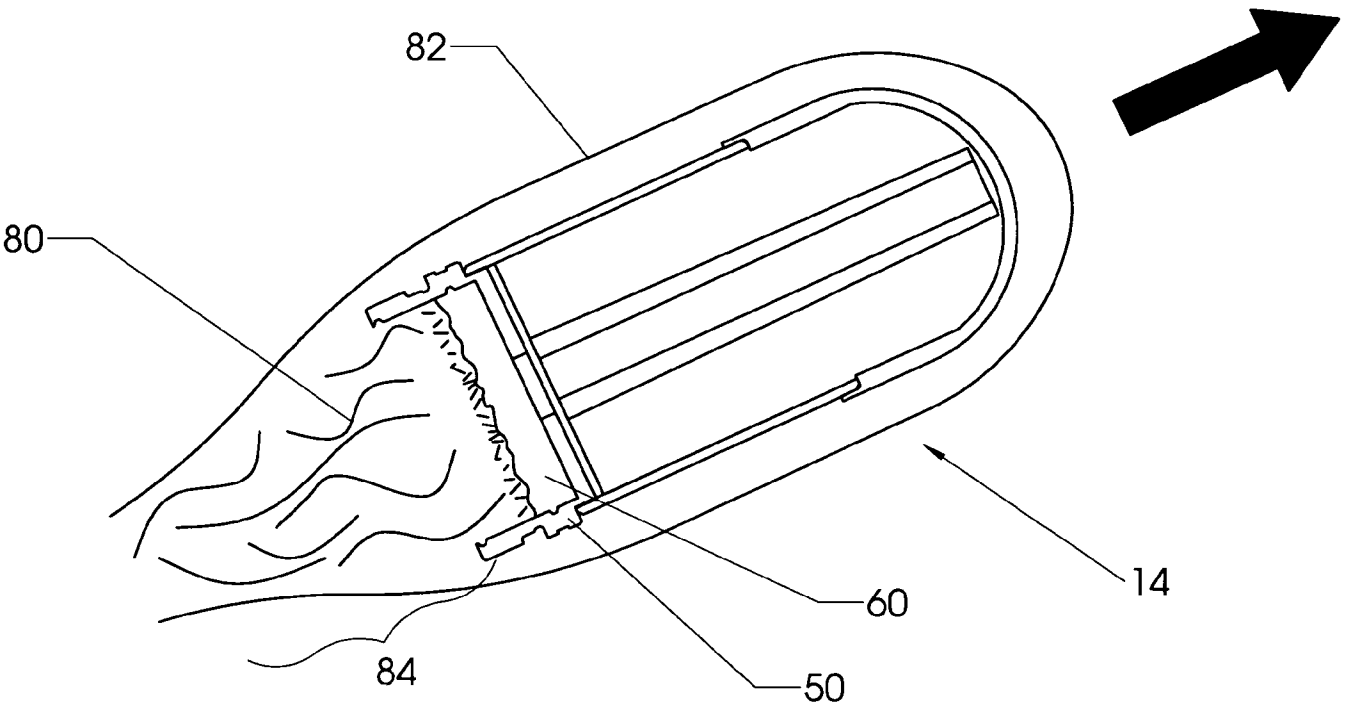
FIG. 8 is a sectional view, showing a projectile in flight.

In FIG. 7, ignition material 64 has ignited as the projectile continues to accelerate down rifled bore 78. The ignition material burns to exhaustion and ignites gas generating material 66. The gas generating material is preferably ignited shortly before the projectile exits the muzzle, but may be ignited at the point of exit or shortly after as well. FIG. 8 shows the projectile after it has exited the muzzle and entered ballistic flight. Air flow 82 flows around the projectile's exterior (a subsonic depiction of flow is shown).

Those skilled in the art will know that air flow around such a projectile produces turbulent wake and resulting base drag. The base drag is actually produced by a region of relatively low pressure immediately behind the projectile in flight. This base drag slows down the projectile. However, in the case of the present invention, propellant gas 80 produced by gas generating material 66 is spewed into the low pressure region, thereby raising the pressure. Base drag is significantly reduced. The artificial pressurization of the wake region produces a sort of streamlined "tail" for the projectile, which is labeled as effective extension 84 in the view. In this context the term "effective" is used to indicate that the artificial pressurization has an effect similar to placing a streamlined "boat tail" shape on the rear of the projectile.

Figure 9:
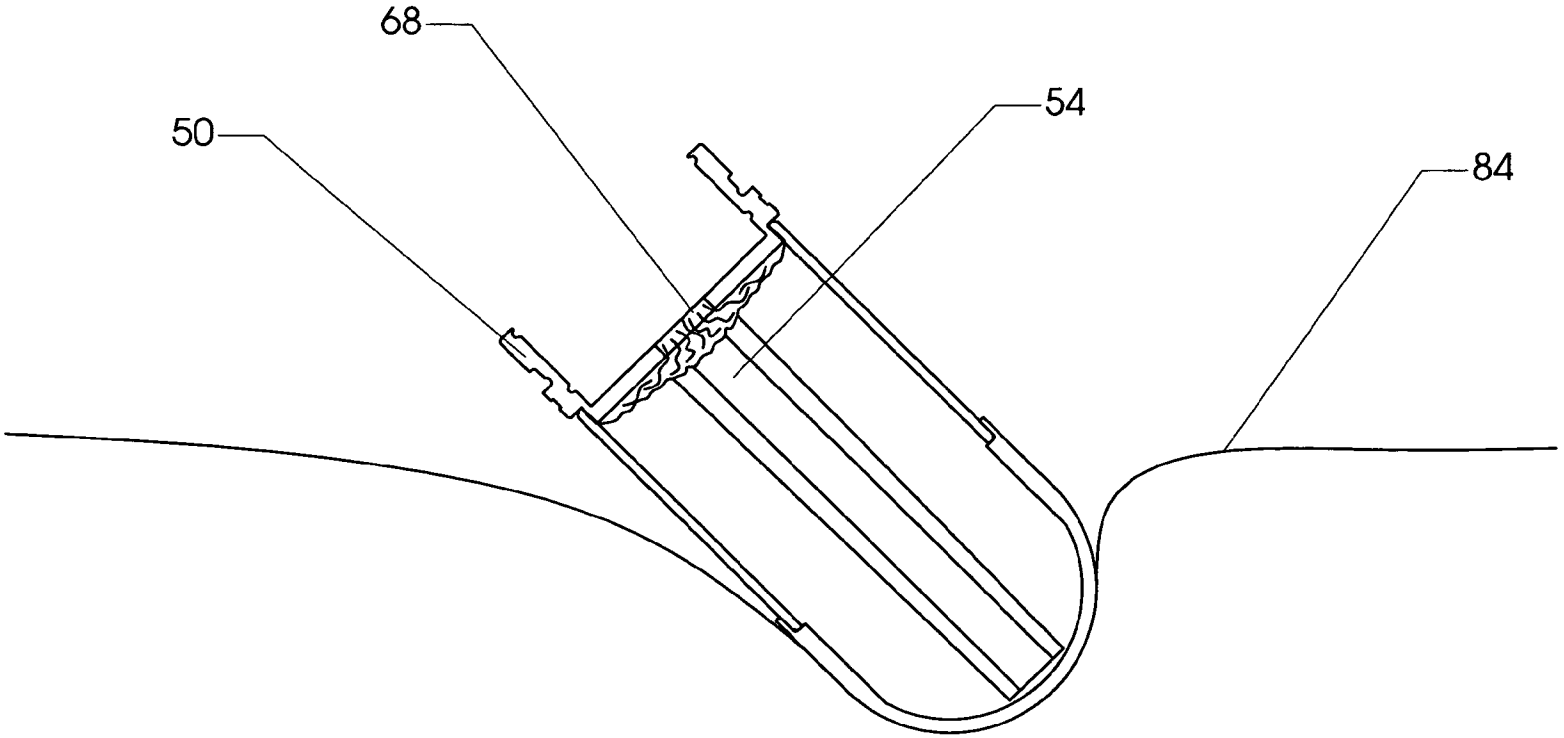
FIG. 9 is a sectional view, showing the ignition of a smoke round.
Figure 10:
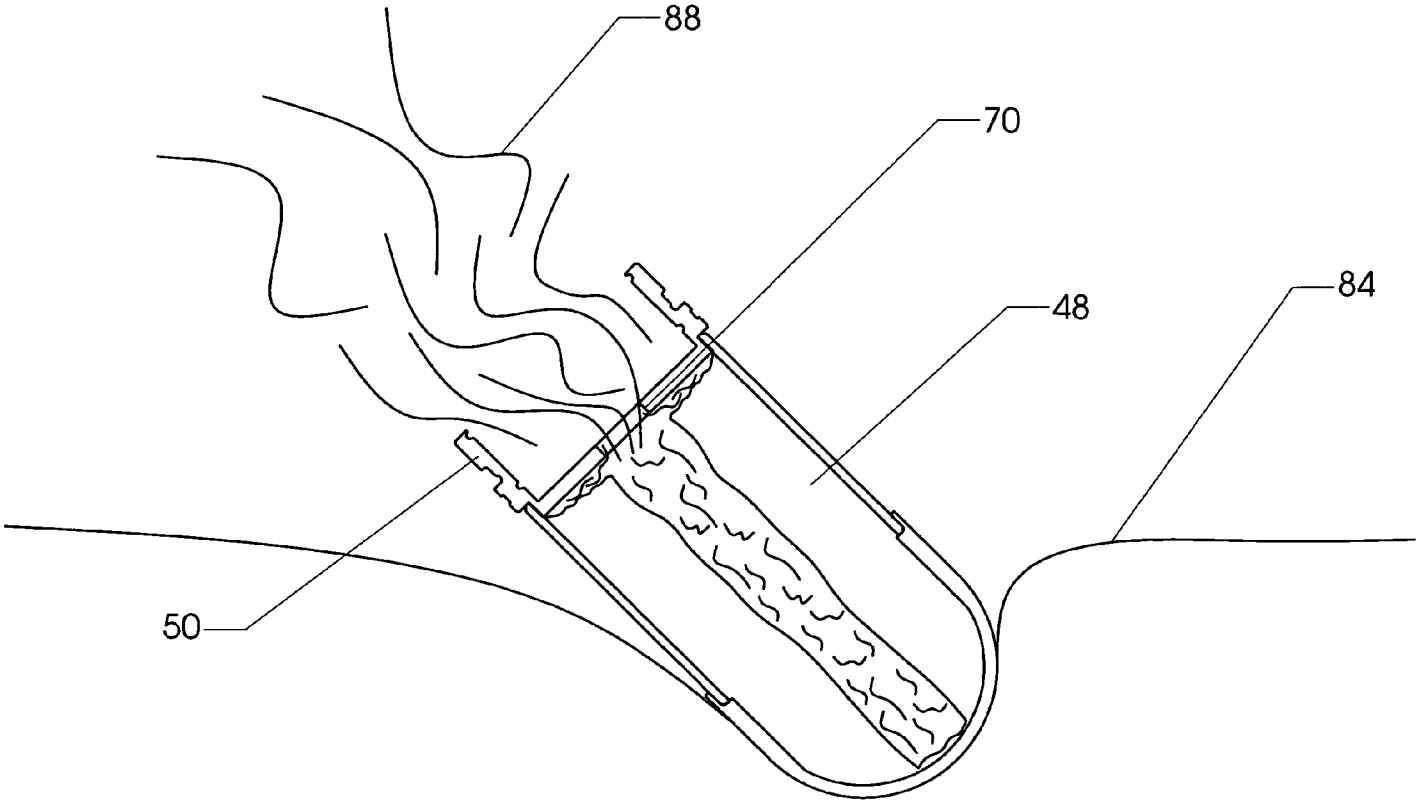
FIG. 10 is a sectional view, showing the burning of a smoke round.

The gas generating material preferably continues to burn through the projectile's flight. In FIG. 9, the projectile has impacted ground 86 and buried its forward portion. At approximately the same time the gas generating material has burned to exhaustion and ignited igniter charge 68. Igniter charge 68 ignites ignition material 54, which burns rapidly along its entire length. In FIG. 10 the ignition material has ignited smoke material 48. The smoke material produces a copious volume of smoke 88 as it burns. The smoke exits the projectile assembly through output opening 70, where it can be readily seen. The smoke is produced until smoke material 48 is exhausted.

The reader will thereby understand that the present invention includes a gas generating component in the base of a projectile. The gas generating component is integrated into an ignition sequence including several other components. In the case of an ignitable payload (such as a marker flare, illumination flare, or smoke round), the gas generating component is part of the sequence that ultimately ignites the payload.

The inclusion of the gas generating component creates several performance advantages. For a given payload, it significantly reduces the propulsion energy needed to reach a given range. The reduction in propulsion energy also reduces the launch impulse ("kick") experienced by the shooter. The cartridge pressure loads applied to the firing weapon are also reduced. The hardware illustrated is preferably made interchangeable with other prior art components, such as standard M433 propellant assemblies.

The reader may wish to know some typical properties of projectiles using the proposed invention. A typical prior art projectile assembly weighs 205 grams. 1000 mg of M9 flake propellant is used in the high pressure cartridge to propel such a projectile assembly to a range of 800 m. With the addition of the gas generating material in the projectile's base, the same range can be achieved using only 700 mg of M9 flake propellant. On the other hand, if 1000 mg of M9 is used with the gas generating approach, the projectile's range is extended to approximately 1000 meters.

Figure 11:
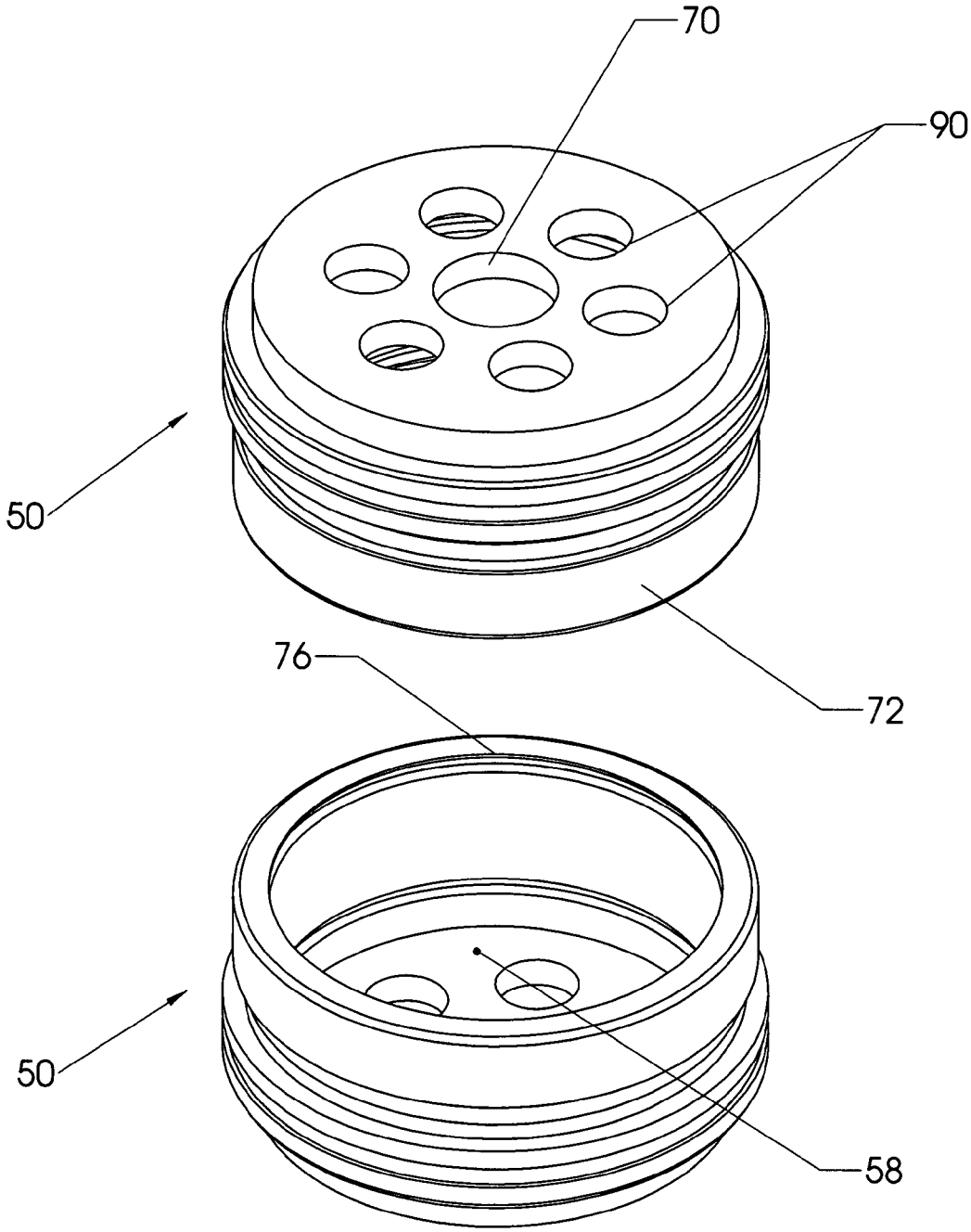
FIG. 11 is a perspective view, showing an alternate embodiment of the aft closure.

As disclosed previously, the present invention can be used with many different types of projectiles. Some hardware modifications are preferable in order to optimize the invention for each type of round. FIG. 11 shows an alternate embodiment of aft closure 50 adapted for use with a marker flare. As for FIG. 5, the upper view shows the aft closure in an upright position while the lower view shows it inverted. The bulkhead has been modified to include a radial array of secondary vents in addition to output opening 70.

Figure 12:
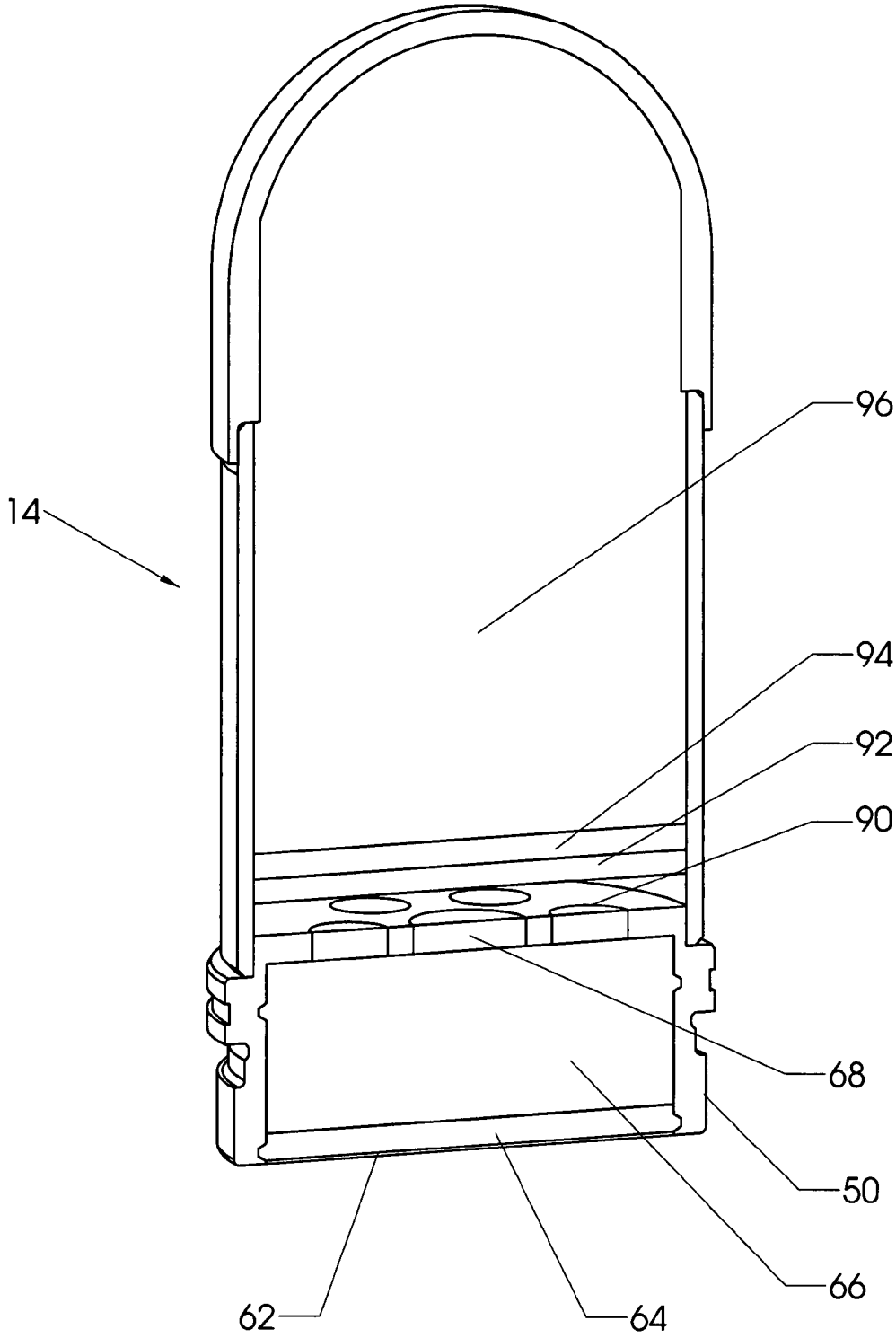
FIG. 12 is a sectional view, showing the invention applied to a marker flare projectile.

FIG. 12 shows the inclusion of this component in a projectile assembly 14 which includes a marker flare. Aft closure 50 includes the same layers (black powder layer 62, ignition material 64, gas generating material 66 and igniter charge 68). The layers burn in the same sequence as for the smoke round. However, when igniter charge 68 fires, it ignites illuminant igniter 92. Illuminant igniter 92 then ignites black powder layer 94, which in turn ignites the aft portion of illuminant composition 96.

The illuminant composition burns intensely, producing a brilliant flare. So much gas is produced that output opening 70 is insufficient for adequate venting. The escaping flame also passes through the array of secondary vents 90. As the illuminant composition continues to burn, the secondary vents and output opening may in fact merge into a single large hole—the intervening webs having been eroded away. This allows the brightly burning flare gases to escape the round and illuminate an area or brightly designate a fixed point.

A similar aft closure assembly can be used for explosive rounds, though the inclusion of an output opening 70 is unnecessary. The payload of an explosive round is typically ignited by impact, so the contents of the aft closure would not be used in an ignition sequence leading to such a payload.

Although the preceding description contains significant detail, it should not be construed as limiting the scope of the invention but rather as providing illustrations of the preferred embodiments of the invention. As an example, the physical characteristics of the ft closure could be modified substantially while still providing the injection of pressurized gas into the projectile's wake region. Thus, the scope of the invention should be fixed by the following claims, rather than by the examples given.

The invention claimed is:

1. A cartridge assembly for reducing the base drag of a projectile in flight, comprising:

a. a low pressure case, having a base and an open end;

b. a high pressure cartridge inserted within said base of said low pressure case, having a closed first end, an open second end, and a continuous side wall running between said first and second ends, thereby defining a hollow interior;

c. propellant, contained within said hollow interior of said high pressure cartridge;

d. a burstable sealing member sealing said open second end of said high pressure cartridge, thereby closing said hollow interior within said high pressure cartridge;

e. wherein said low pressure case includes a charge casing surrounding said high pressure cartridge;

f. a projectile assembly seated in said open end of said low pressure case;

g. wherein said projectile assembly includes an aft closure having an aft opening;

h. wherein said aft closure includes a volume of gas generating material sufficient to inject pressurizing gas into the wake of said projectile assembly, through said aft opening, for a substantial portion of said flight of said projectile;

i. wherein said low pressure case further includes a charge vent hole positioned to direct hot propellant gas from said high pressure cartridge toward said aft opening in said aft closure;

j. said gas generating material being contained within a cavity in said aft closure;

k. said aft opening lying at the aft extreme of said cavity;

l. said aft closure including a forward extreme including a bulkhead;

m. said bulkhead opening into an output allowing fluid communication between said cavity and the area forward of said bulkhead;

n. an igniter charge located proximate said output opening;

o. an ignitable payload located forward of said bulkhead and configured to be ignited by said igniter charge, said ignitable payload having an interior cavity; and p. a piece of ignition material having a forward portion and an aft portion, said piece of ignition material being located within said interior cavity in said ignitable payload, with said aft portion of said ignition material being proximate said igniter charge.

2. A cartridge assembly as recited in claim 1, wherein said ignitable payload comprises a volume of illuminant composition proximate said piece of ignition material.

3. A cartridge assembly as recited in claim 1, wherein said bulkhead in said aft closure further comprises a plurality of secondary vents allowing fluid communication between said cavity and the area forward of said bulkhead.

4. A cartridge assembly as recited in claim 3, wherein said plurality of secondary vents are arranged in a radial array around said output opening.

5. A cartridge assembly as recited in claim 1 wherein said ignitable payload includes an explosive charge.

6. A cartridge assembly as recited in claim 2, wherein said ignitable payload includes an explosive charge.

7. A cartridge assembly as recited in claim 1 wherein said ignitable payload includes a volume of smoke material.

8. A cartridge assembly as recited in claim 1, wherein said ignitable payload includes an explosive charge.

9. A cartridge assembly as recited in claim 1, wherein said cavity further comprises at least one mechanical interference feature configured to retain said gas generating material within said cavity.

10. A cartridge assembly as recited in claim 2, wherein said cavity further comprises at least one mechanical interference feature configured to retain said gas generating material within said cavity.

11. A cartridge assembly for reducing the base drag of a projectile in flight, comprising:

a. a low pressure case, having a base and an open end;

b. a high pressure cartridge inserted within said base of said low pressure case, said high pressure cartridge having a hollow interior;

c. propellant, contained within said hollow interior of said high pressure cartridge;

d. a burstable sealing member sealing said high pressure cartridge;

e. a projectile assembly seated in said open end of said low pressure case;

f. wherein said projectile assembly includes an aft closure having an aft opening;

g. wherein said aft closure includes a volume of gas generating material sufficient to inject pressurizing gas into the wake of said projectile assembly, through said aft opening, for a substantial portion of said flight of said projectile;

h. wherein said low pressure case further includes a charge vent hole positioned to direct hot propellant gas from said high pressure cartridge toward said aft opening in said aft closure;

i. said gas generating material being contained within a cavity in said aft closure;

j. said aft opening lying at the aft extreme of said cavity;

k. said aft closure including a forward extreme including a bulkhead;

l. said bulkhead opening into an output allowing fluid communication between said cavity and the area forward of said bulkhead;

m. an igniter charge located proximate said output opening;

n. an ignitable payload located forward of said bulkhead and configured to be ignited by said igniter charge, said ignitable payload having an interior cavity; and o. a piece of ignition material having a forward portion and an aft portion, said piece of ignition material being located within said interior cavity in said ignitable payload, with said aft portion of said ignition material being proximate said igniter charge.

12. A cartridge assembly as recited in claim 11, wherein said ignitable payload comprises a volume of illuminant composition proximate said piece of ignition material.

13. A cartridge assembly as recited in claim 11, wherein said bulkhead in said aft closure further comprises a plurality of secondary vents allowing fluid communication between said cavity and the area forward of said bulkhead.

14. A cartridge assembly as recited in claim 11, wherein said plurality of secondary vents are arranged in a radial array around said output opening.

15. A cartridge assembly as recited in claim 11 wherein said ignitable payload includes an explosive charge.

* * * * *